US006502768B2

(12) United States Patent
Chang

(10) Patent No.: US 6,502,768 B2
(45) Date of Patent: Jan. 7, 2003

(54) WATER SPRAYING GUN

(75) Inventor: Ta-Chun Chang, Taichung Hsien (TW)

(73) Assignee: Globe Union Industrial Corp. (TW)

( * ) Notice: Subject to any disclaimer, the term of this patent is extended or adjusted under 35 U.S.C. 154(b) by 86 days.

(21) Appl. No.: 09/835,466

(22) Filed: Apr. 16, 2001

(65) Prior Publication Data

US 2002/0148914 A1 Oct. 17, 2002

(51) Int. Cl.[7] ..... B05B 7/02

(52) U.S. Cl. ..... 239/526; 239/525; 239/571; 239/583; 251/240; 137/218

(58) Field of Search ..... 239/525, 526, 239/530, 569, 571, 583; 251/240, 241, 245; 137/218, 614.2

(56) References Cited

U.S. PATENT DOCUMENTS 4,344,578 A * 8/1982 Shames et al. ..... 239/583
4,396,156 A * 8/1983 Southworth et al. ..... 239/526
4,927,115 A * 5/1990 Bahroos et al. ..... 251/241
5,145,114 A * 9/1992 Monch ..... 239/447
5,662,276 A * 9/1997 Ko ..... 239/526
5,806,771 A * 9/1998 Loschelder et al. ..... 239/526
6,173,910 B1 * 1/2002 Tean ..... 239/525

* cited by examiner

*Primary Examiner*—Michael Mar
*Assistant Examiner*—Dinh Q. Nguyen
(74) *Attorney, Agent, or Firm*—Cook, Alex, McFarron, Manzo, Cummings & Mehler, Ltd.

(57) ABSTRACT

A water spraying gun includes a gun body having a mounting cavity with an upright mounting wall and a horizontal base wall. The mounting wall is formed with a pair of horizontal insert plates below amounting hole. A receiving space is formed between the insert plates and the base wall. A valve switch is mounted on the gun body within the mounting cavity. An operating lever has a mounting head portion with a vertical connecting rib extending between spaced-apart top and bottom walls, a pair of insert grooves on opposite sides of the connecting rib and between the top and bottom walls, and a forward mounting projection. The bottom wall has a valve engaging portion for engaging the valve switch. The mounting projection and the bottom wall extend respectively into the mounting hole and the receiving space to enable the insert plates to extend respectively into the insert grooves.

7 Claims, 5 Drawing Sheets

WATER SPRAYING GUN

BACKGROUND OF THE INVENTION

1. Field of the Invention

The present invention relates to a water or spraying gun, more particularly to a water spraying gun with an operating lever which can be easily assembled to a gun body and which is less susceptible to breakage.

2. Description of the Related Art

Referring to FIG. 1, a conventional water spraying gun 10 is shown to include a gun body 11 and an operating lever 12 mounted in a rear cavity 111 of the gun body 11. The gun body 11 is formed with left and right hollow mounting seats 112 in the mounting cavity 111. Each of the mounting seats 112 extends in a front-to-rear direction and confines an elongated mounting hole 113 with a rearward opening. The mounting seats 112 are spaced-part from each other so as to form a clearance 114 therebetween. The operating lever 12 has an upper end portion formed with a forwardly extending first mounting strip 122 and a pair of forwardly extending second mounting strips 121 on left and right sides of and below the first mounting strip 122. The first mounting strip 122 extends into the clearance 114, whereas the second mounting strips 121 extend respectively into the mounting holes 113 for mounting the operating lever 12 on the gun body 11. The operating lever 12 is depressible for actuating a valve switch 115 disposed in the mounting cavity 111 of the gun body 11 so as to control fluid flow through the gun body 11. In the case the operating lever 12 is improperly operated, for example, when the operating lever 12 is lifted upwardly, the second mounting strips 121 do not break immediately. However, after the water spraying gun 10 has been in use for a period of time, each of the second mounting strips 121 would unavoidably form a stress concentrating part which is relatively weak and which can be easily broken once the operating lever 12 is improperly operated again. Moreover, since the first and second mounting strips 122, 121 are spaced-apart from one another, their individual strengths are not strong enough. Furthermore, the requirement in shape accuracy for the mounting strips 122, 121 and the mounting seats 112 should be relatively high during manufacture so as to permit assembly of the operating lever 12 to the gun body 11. This increases the manufacturing cost of the conventional water spraying gun 10.

SUMMARY OF THE INVENTION

Therefore, the main object of the present invention is to provide a water spraying gun with an operating lever which can be easily assembled to a gun body and which is less susceptible to breakage.

Accordingly, the water spraying gun of the present invention includes a gun body, a depressible valve switch, and an operating lever. The gun body has a barrel part with front and rear end portions, and a handle part extending downwardly from the rear end portion of the barrel part. The rear end portion of the barrel part is formed with a mounting cavity, an upright mounting wall which faces rearwardly and which defines a front periphery of the mounting cavity, and a horizontal base wall which extends rearwardly from the mounting wall and which defines a bottom periphery of the mounting cavity. The mounting wall is formed with amounting hole and a pair of rearwardly projecting horizontal insert plates below the mounting hole. The insert plates are spaced apart from each other in a horizontal direction, and are spaced-apart from the base wall to define a receiving space with the base wall. The valve switch is mounted on the gun body within the mounting cavity, and is actuatable for controlling fluid flow through the handle part and the barrel part of the gun body. The operating lever is mounted on the gun body in the mounting cavity, and has a lever portion and a mounting head portion which extends forwardly from an upper end of the lever portion. The mounting head portion has spaced-apart top and bottom walls and a vertical connecting rib that extends between the top and bottom walls and that interconnects the top and bottom walls so as to cooperate with the top and bottom walls to define a pair of insert grooves on opposite lateral sides of the connecting rib and between the top and bottom walls. The insert grooves open forwardly for receiving the insert plates, respectively. The mounting head portion is further formed with a mounting projection which projects forwardly relative to the top and bottom walls and which is extendible into the mounting hole in the gun body. The bottom wall has a valve engaging portion for engaging the valve switch such that the operating lever is operable for actuating the valve switch. The mounting projection and the bottom wall extend respectively into the mounting hole and the receiving space to enable the insert plates to be inserted respectively into the insert grooves. The bottom wall of the mounting head portion forms a clearance with the base wall when extended into the receiving space.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
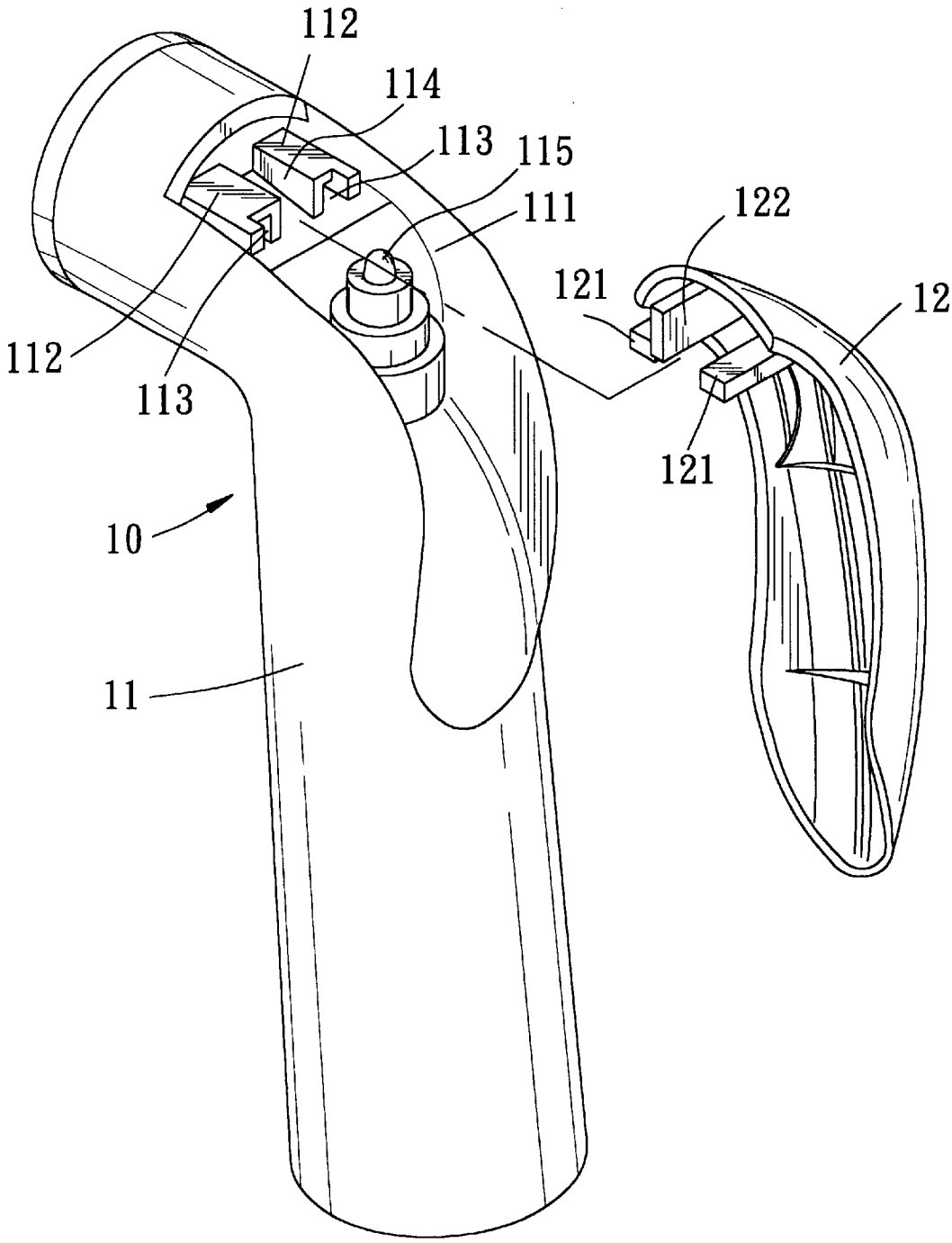
FIG. 1 PRIOR ART
FIG. 1 is an exploded perspective view of a conventional water spraying gun.
Figure 2:
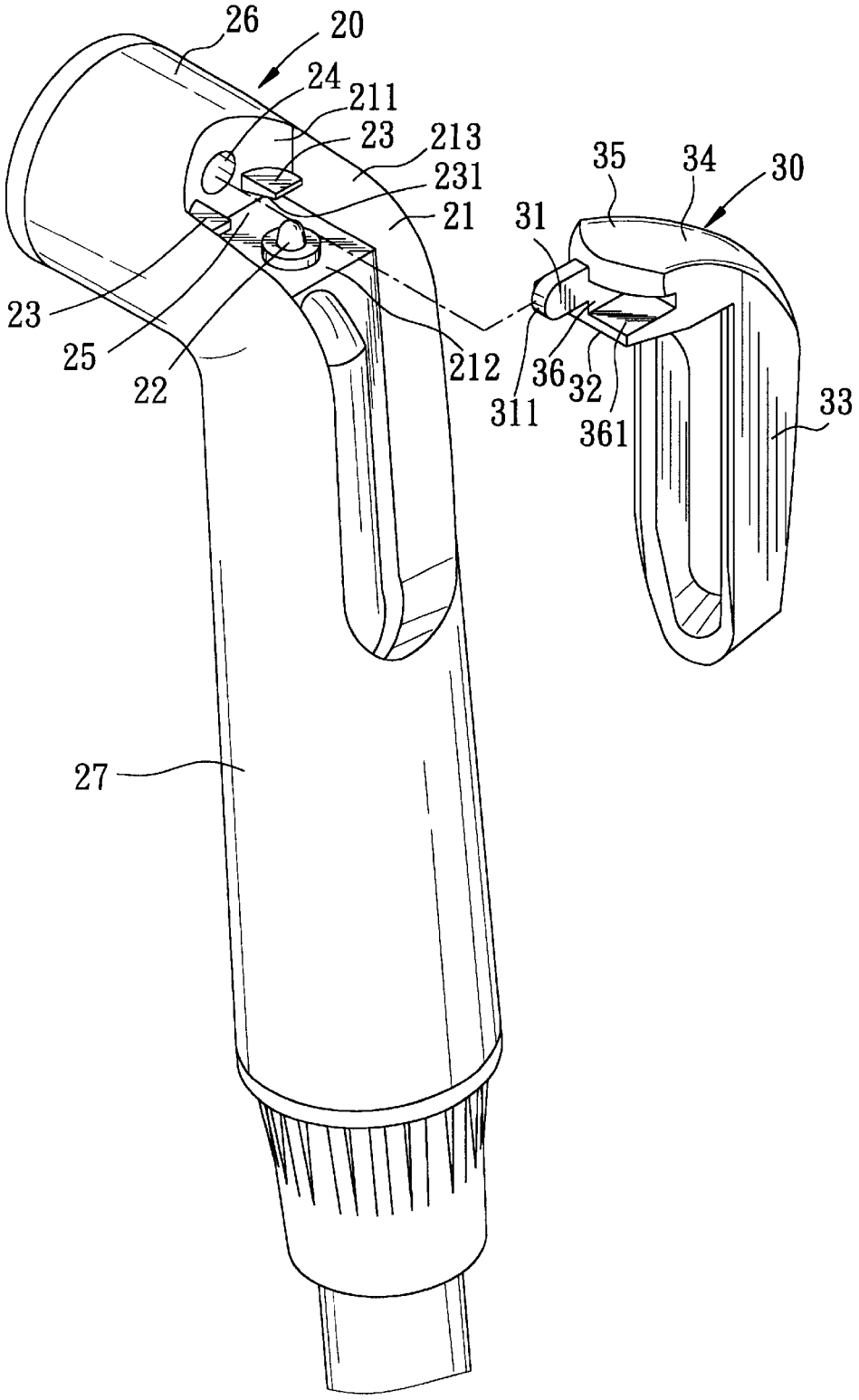
FIG. 2 is an exploded perspective view of a preferred embodiment of the water spraying gun of the present invention.
Figure 3:
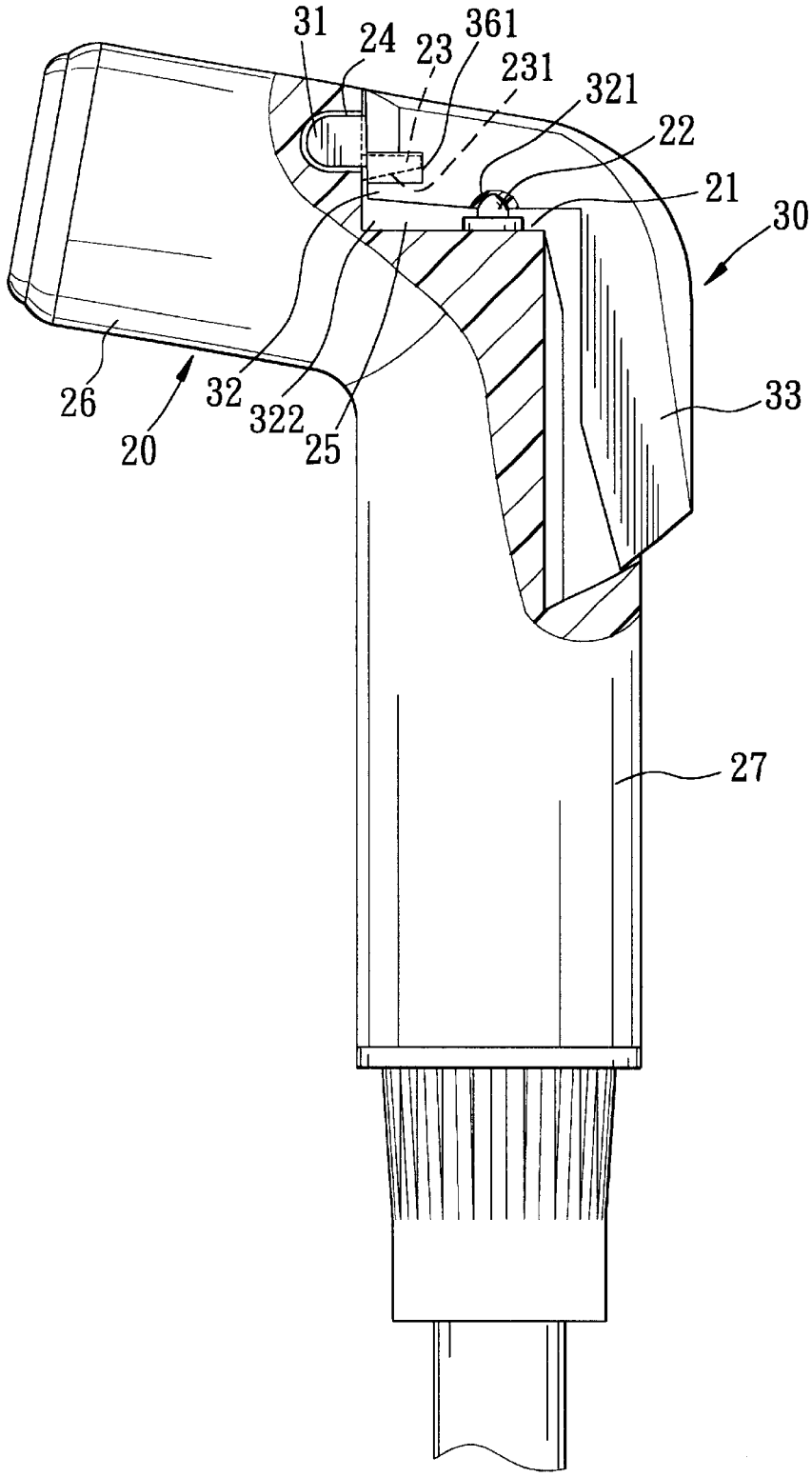
FIG. 3 is a partly sectional side view of the preferred embodiment.

Referring to FIGS. 2 and 3, the preferred embodiment of the water spraying gun of the present invention is shown to include a gun body 20 and an operating lever 30 mounted operably on the gun body 20 at a rear side of the latter. The gun body 20 has a barrel part 26, and a handle part 27 extending downwardly from a rear end portion of the barrel part 26. A mounting cavity 21 is formed on a rear side surface of the gun body 20, and extends from the rear end portion of the barrel part 26 to an upper end portion of the handle part 27. A valve switch 22 is provided in the mounting cavity 21 and is actuatable to control fluid flow through the handle part 27 and the barrel part 26 of the gun body 20. The operating lever 30 has a lever portion 33 and a mounting head portion 34 extending forwardly from an upper end of the lever portion 33. The operating lever 30 is mounted on the gun body 20 in the mounting cavity 21, and is operable to actuate the valve switch 22 such that when the operating lever 30 is depressed, a water jet output can be released from a front end portion of the barrel part 26.

In the mounting cavity 21, the gun body 20 has an upright mounting wall 211 and a horizontal base wall 212 extending rearwardly from a lower end of the upright mounting wall 211. The upright mounting wall 21 faces rearward, and defines a front periphery of the mounting cavity 21. The base wall 212 faces upwardly, and defines a bottom periphery of the mounting cavity 21. The mounting wall 211 is formed with a round mounting hole 24, and a pair of rearwardly projecting, horizontal insert plates 23 below the mounting hole 24. The insert plates 23 are formed adjacent to and are connected respectively to left and right inner surfaces 213 that face the mounting cavity 21. The insert plates 23 are spaced-apart from each other and are flush with each other in a horizontal direction. The insert plates 23 are spaced-apart from the base wall 212 so as to define a receiving space 25 with the base wall 212. Each of the insert plates 23 has a bottom surface 231 which is inclined upwardly and rearwardly such that the receiving space 25 has a broadened rear entrance. The valve switch 22 is mounted on the base wall 212 posteriorly of the insert plate 23.

Figure 4:
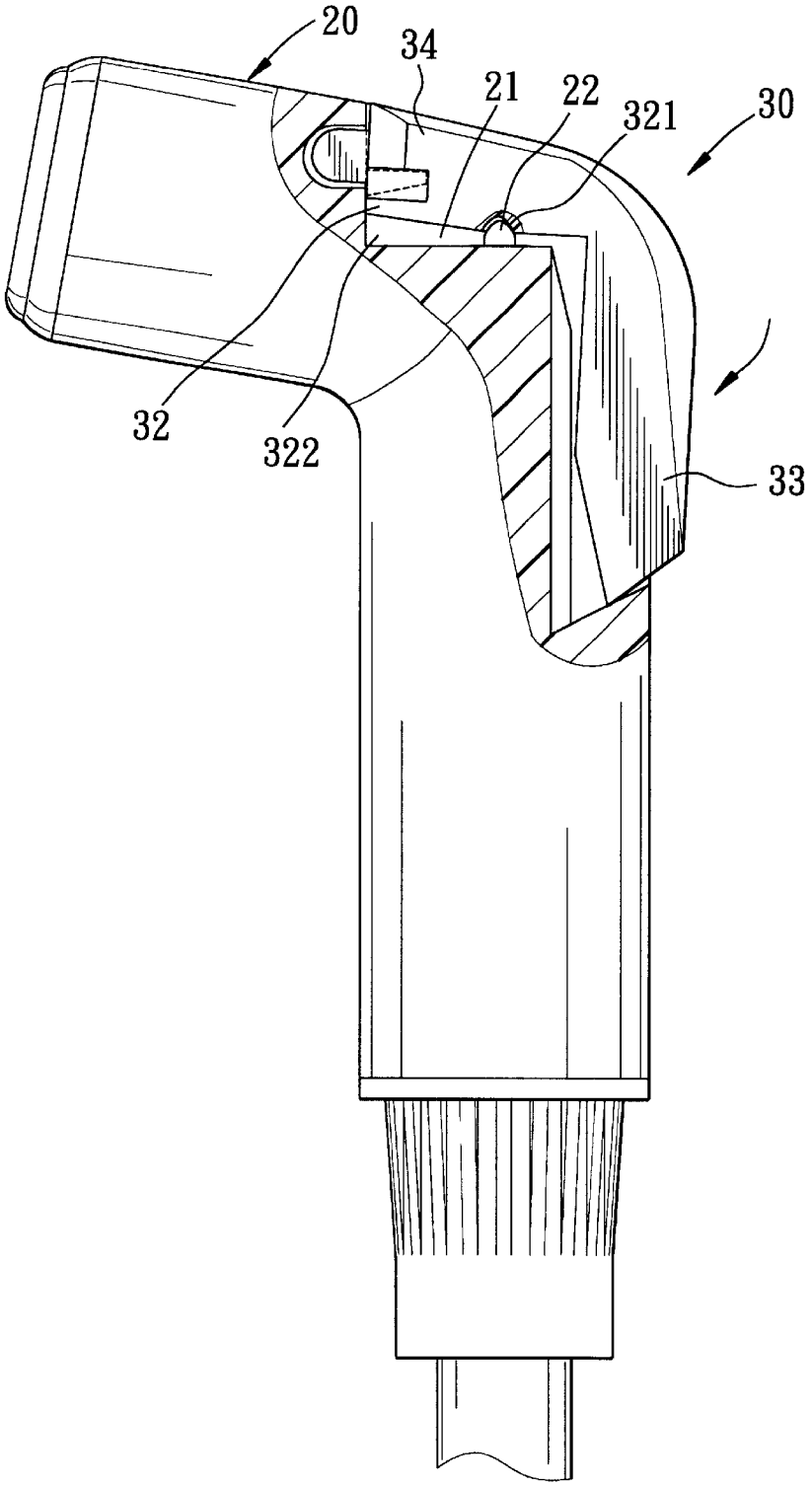
FIG. 4 is another partly sectional side view of the preferred embodiment, illustrating operation of an operating lever.

The mounting head portion 34 of the operating lever 30 is formed integrally with spaced-apart top and bottom walls 35, 32, and a vertical connecting rib 36 extending between the top and bottom walls 35, 32 to interconnect the same. The connecting rib 36 cooperates with the top and bottom walls 35, 32 to define a pair of insert grooves 361 on opposite lateral sides of the connecting rib 36 and between the top and bottom walls 35, 32. The insert grooves 361 open forwardly and respectively to left and right sides of the mounting head portion 34 for receiving the insert plates 23, respectively. A mounting projection 31 extends integrally from the connecting rib 36 along the same vertical plane, and projects forwardly relative to the top and bottom walls 35, 32. The mounting projection 31 has a convex front edge 311 and a size smaller than the size of the mounting hole 24. When the operating lever 30 is assembled to the gun body 20, the mounting projection 31 is extendible into the mounting hole 24 and the bottom wall 32 is extendible into the receiving space 25 to enable insertion of the insert plates 23 into the insert grooves 361, respectively. The bottom wall 32 of the mounting head portion 34 has a bottom surface formed with an indented valve engaging portion 321 for engaging the valve switch 22 in a manner that when the operating lever 30 is depressed (see FIG. 4), the valve switch 22 would be depressed and actuated in order to permit the passage of fluid flow through the gun body 20. The bottom wall 32 has a thickness which is gradually reduced in a forward direction to form the bottom wall 32 with a generally wedge-shape cross-section. The bottom wall 32 forms a clearance 322 with the base wall 212 of the gun body 20 when the operating lever 30 is mounted in the mounting cavity 21 of the gun body 20.

During assembly, the mounting head portion 34 of the operating lever 30 is disposed at a rear side of the gun body 20, and faces the mounting cavity 21. The mounting projection 31 and the bottom wall 32 are inserted respectively into the mounting hole 24 and the receiving space 25 to allow simultaneous insertion of the insert plates 23 into the insert grooves 361. Since the bottom surfaces 231 of the insert plates 23 are inclined upwardly and rearwardly to guide insertion of the bottom wall 32, and since the bottom wall 32 has a thinner front edge, the mounting head portion 34 can be easily assembled to the gun body 20 in the mounting cavity 21.

Figure 5:
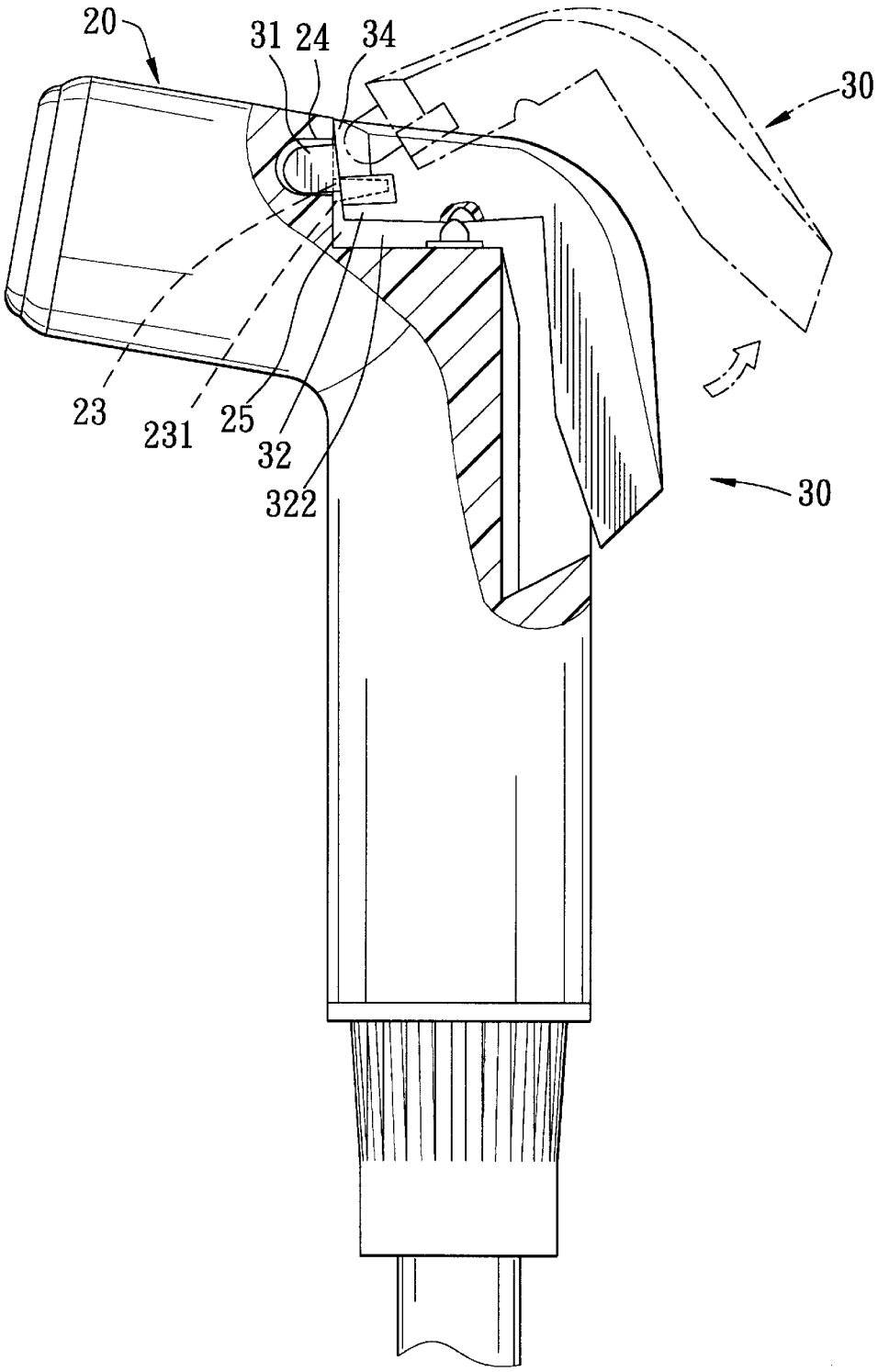
FIG. 5 is yet another partly sectional side view of the preferred embodiment, where the operating lever is shown to be lifted.

Referring to FIG. 5, once the operating lever 30 is incorrectly or improperly lifted upwardly by the user during use of the water spraying gun, the mounting head portion 34 is allowed to turn within the mounting cavity 21 since the size of the mounting projection 31 is smaller than the mounting hole 24 and since the bottom wall 32 is turnable within the receiving space 25 due to the presence of the clearance 322. With the inclined bottom surfaces 231 of the insert plates 23 to guide removal of the bottom wall 32 from the receiving space 25, continuous upward lifting of the operating lever 30 will cause removal of the mounting head portion 34 from the mounting cavity 21, as shown in broken lines in FIG. 5. The insert plates 23 on the gun body 20 and the mounting projection 31 on the operating lever 30 are thus prevented from breaking.

The following advantages are attained with the use of the water spraying gun of the present invention:

1. Since the top and bottom walls 35, 32 and the mounting projection 31 are connected integrally to one another, the combined structural strength of the mounting head portion 34 is enhanced, and the stress applied to the operating lever 30 can be distributed among different structural parts thereof to prevent breakage of the structure parts.

2. With a pair of insert plates 23 and a mounting hole 24, the gun body 20 has a relatively simple structure within the mounting cavity 21, when compared with the aforementioned prior art. Moreover, since the top and bottom walls 35, 32 and the mounting projection 31 of the operating lever 30 are connected integrally to each other, the operating lever 30 can be easily formed by molding to simplify the manufacture thereof. Furthermore, the requirement in shape accuracy would not be too high and can be easily achieved in order to enable assembly of the mounting head portion 34 in the mounting cavity 21. While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A water spraying gun comprising:

a gun body having a barrel part with front and rear end portions, and a handle part extending downwardly from said rear end portion of said barrel part, said rear end portion of said barrel part being formed with a mounting cavity, an upright mounting wall which faces rearwardly and which defines a front periphery of said mounting cavity, and a horizontal base wall which extends rearwardly from said mounting wall and which defines a bottom periphery of said mounting cavity, said mounting wall being formed with a mounting hole and a pair of rearwardly projecting horizontal insert plates below said mounting hole, said insert plates being spaced apart from each other in a horizontal direction and being spaced-apart from said base wall to define a receiving space with said base wall;

a depressible valve switch mounted on said gun body within said mounting cavity, said valve switch being actuatable for controlling fluid flow through said handle part and said barrel part of said gun body; and an operating lever mounted on said gun body in said mounting cavity, said operating lever having a lever portion and a mounting head portion which extends forwardly from an upper end of said lever portion, said mounting head portion having spaced-apart top and bottom walls and a vertical connecting rib that extends between said top and bottom walls and that interconnects said top and bottom walls so as to cooperate with said top and bottom walls to define a pair of insert grooves on opposite lateral sides of said connecting rib and between said top and bottom walls, said insert grooves opening forwardly for receiving said insert plates, respectively, said mounting head portion being further formed with a mounting projection which projects forwardly relative to said top and bottom walls and which is extendible into said mounting hole in said gun body, said bottom wall having a valve engaging portion for engaging said valve switch such that said operating lever is operable for actuating said valve switch, said mounting projection and said bottom wall extending respectively into said mounting hole and said receiving space to enable said insert plates to be inserted respectively into said insert grooves, said bottom wall of said mounting head portion forming a clearance with said base wall when extended into said receiving space.

2. The water spraying gun as claimed in claim 1, wherein said connecting rib interconnects integrally said top and bottom walls, said mounting projection extending forwardly and integrally from said rib.

3. The water spraying gun as claimed in claim 1, wherein each of said insert plates has an inclined bottom surface to guide insertion and removal of said bottom wall of said mounting head portion into and from said receiving space.

4. The water spraying gun as claimed in claim 1, wherein said bottom wall of said mounting head portion tapers forwardly.

5. The water spraying gun as claimed in claim 1, wherein said mounting projection has a convex front edge.

6. The water spraying gun as claimed in claim 5, wherein said mounting projection has a size smaller than that of said mounting hole.

7. The water spraying gun as claimed in claim 1, wherein said gun body further has left and right inner surfaces that face said mounting cavity, said insert plates being connected to said left and right inner surfaces, respectively, said mounting head portion having left and right sides, said insert grooves in said mounting head portion opening in said left and right sides of said mounting head portion, respectively.

* * * * *